United States Patent [19]

Lenk et al.

[11] Patent Number: 4,817,880

[45] Date of Patent: Apr. 4, 1989

[54] YARN WITHDRAWAL APPRATUS AND METHOD

[75] Inventors: Erich Lenk, Remscheid; Albert Stitz, Kürten, both of Fed. Rep. of Germany

[73] Assignee: Barmag AG, Remscheid, Fed. Rep. of Germany

[21] Appl. No.: 38,334

[22] Filed: Apr. 14, 1987

Related U.S. Application Data

[63] Continuation-in-part of Ser. No. 8,490, Jan. 29, 1987.

[30] Foreign Application Priority Data

| | | | |
|---|---|---|---|
| Apr. 17, 1986 | [DE] | Fed. Rep. of Germany | 3613040 |
| May 2, 1986 | [DE] | Fed. Rep. of Germany | 3614864 |
| Jun. 24, 1986 | [DE] | Fed. Rep. of Germany | 3621139 |
| Dec. 8, 1986 | [DE] | Fed. Rep. of Germany | 3641849 |

[51] Int. Cl.[4] ..... B65H 51/22; B65H 54/88

[52] U.S. Cl. ..... 242/47.01; 242/18 R; 242/47.03; 242/47.09; 226/97; 226/108; 28/289

[58] Field of Search ..... 242/47.01, 47.03, 47.08, 242/47.09, 47.1, 47.11, 47.12, 47.13, 47, 18 R, 45, 18 PW, 18 A; 226/97, 34, 24, 168, 184, 108; 28/289

[56] References Cited

U.S. PATENT DOCUMENTS

| | | | |
|---|---|---|---|
| 1,962,029 | 6/1934 | Murphy et al. | 226/184 |
| 2,350,182 | 5/1944 | Neff | 242/47.09 X |
| 2,539,978 | 1/1951 | Van Dijk | 226/184 |
| 2,667,052 | 1/1954 | Lebocey | 242/47.01 X |
| 2,744,399 | 5/1956 | West | 242/47.12 |
| 2,885,257 | 5/1959 | Courtney et al. | 226/97 X |
| 2,929,179 | 3/1960 | George | 28/289 |
| 3,083,924 | 4/1963 | Vossen et al. | 242/47.12 |
| 3,144,187 | 8/1964 | Naumann | 226/97 |
| 3,272,416 | 9/1964 | Emery | 226/97 |
| 3,433,424 | 3/1969 | Rover et al. | 242/47 |
| 3,706,407 | 12/1972 | King et al. | 226/97 |
| 3,912,185 | 10/1975 | Yamada | 242/47.03 |
| 3,917,141 | 11/1975 | Sartori | 242/97 |
| 4,127,983 | 12/1978 | Munker | 226/97 |
| 4,638,955 | 1/1987 | Schippers et al. | 242/18 PW |

FOREIGN PATENT DOCUMENTS 1057118 2/1967 United Kingdom .

*Primary Examiner*—Stanley N. Gilreath
*Attorney, Agent, or Firm*—Bell, Seltzer, Park & Gibson

[57] ABSTRACT

A yarn withdrawal apparatus is disclosed for temporarily withdrawing a freshly spun and continuously advancing yarn to a waste container when the spinning operation is interrupted, and for thereafter threading the yarn onto the feed godet or winder of the spinning machine. The apparatus includes a yarn advancing means in the form of one or more rolls and which is adapted to have the yarn looped thereabout. Drive means is provided for rotating the roll or rolls of the advancing means, and a suction means is provided for withdrawing the yarn from the advancing means. In one embodiment, the yarn is initially drawn into the suction means, and then looped about the rotating roll of rolls which serve to frictionally engage the yarn and apply a high yarn tension, and so that the yarn is then in condition to be threaded onto the feed godet of the spinning machine. In another embodiment, a pneumatic system is provided which serves to loop the yarn about a single rotating roll and then guide the yarn into the suction means, and so that the roll again serves to impart a high degree of tension to the yarn.

26 Claims, 1 Drawing Sheet

YARN WITHDRAWAL APPRATUS AND METHOD

CROSS REFERENCE TO RELATED APPLICATION

The present application is a continuation-in-part of copending application Ser. No. 8,490, filed Jan. 29, 1987.

BACKGROUND OF THE INVENTION

The present invention relates to an apparatus and method for withdrawing a continuously advancing yarn with a suction device which removes the yarn in an air stream. More particularly, the present invention relates to an apparatus and method for threading up a freshly spun synthetic filament yarn onto fast moving machine parts, and as the yarn continuously advances from a spinneret.

The design and construction of yarn suction devices, such as the so called suction guns, have been a source of difficulty, since they are unable to provide adequately high yarn tensions where the yarn speeds are greater than about 4,000 meters per minute (65–70 meters per second). Such suction guns generally serve the purpose of withdrawing a continuously advancing yarn, particularly synthetic filament yarn, when the spinning operation is interrupted, for example, in order to doff packages, and the withdrawn yarn is diverted to a waste container. In such suction guns, the yarn is subjected to a strong air current. However, the applicability of such devices is limited to yarn speeds of about 4,000 meters per minute, since at these high speeds, the present suction devices are not able to provide the required yarn tension in order to thread up the yarn on the feed godet or take-up device of the spinning machine. With inadequate tension, it is likely that the yarn will form a lap on the godet or take-up device. In addition, the compressors or vaccuum pumps which are required at these high yarn speeds, become a significant cost factor by reason of their large power requirement, even though these devices are needed only temporarily when the operations are interrupted. Further, the efficiency of the known suction guns and air injectors is so low that their use becomes uneconomical at high yarn speeds.

To overcome the limitations of the known yarn suction devices as outlined above, it has been suggested that the suction current be generated by a liquid, such as water, and with pressures of about 80 bar and above. However, this method has not proven to be successful, since the requirement of removing the required quantities of water without undue expense has presented a difficult problem. In addition, hydraulic problems developed, since even a pressure of 51 bar is necessary for a frictionless flow of fluid in order to obtain a velocity flow of about 6,000 meters per minute (100 meters per second). Further, it is necessary that the yarn be first advanced by an air suction current, and then by a fluid current, which further complicates the design.

It is accordingly an object of the present invention to provide a yarn withdrawal apparatus and method which overcomes the above noted limitations of the prior systems, and which is adapted to withdraw a yarn at high speed and relatively high yarn tension, and so as to facilitate its thread-up onto the rapidly moving components of the spinning machine.

SUMMARY OF THE INVENTION

The above and other objects and advantages of the present invention are achieved in the embodiments illustrated herein by the provision of a yarn withdrawal apparatus and method which comprises yarn advancing means which includes at least one rotatable roll which is adapted to be looped by the advancing yarn, drive means for rotating the at least one roll at a predetermined rotational speed, and suction means having an inlet opening closely adjacent the yarn advancing means for withdrawing the yarn which is looped about the yarn advancing means. Thus in accordance with the present invention, the yarn advancing means directly precedes the suction means, and the inlet opening is arranged directly adjacent the surface of the roll and preferably tangent to the same. Also, the yarn advancing means, drive means, and the suction means are all mounted to a common support structure, which in turn may be either fixed to the spinning machine or configured to permit it to be manipulated by the machine operator in the manner of a suction gun.

The present invention includes provision for avoiding the formation of laps on the yarn advancing means, and to this end, one embodiment of the invention provides for two advancing rolls which are slightly spaced apart from each other and which rotate in the same direction, with at least one of the rolls being driven, and with the axes of the rolls intersecting each other at an acute angle. The yarn is guided over the advancing rolls so that it initially contacts the rolls in the area of the large separation between the axes, and the suction means is positioned in the area where the distance between the axes is least. By this arrangement, the suction means may follow the yarn advancing rolls in a substantially axial direction, and partially enclose the end of the advancing rolls, in which case a yarn guide is provided for preventing the yarn from unwinding overhead from the advancing rolls. Alternatively, the suction means may be disposed transversely to the axes of the rolls, and so that the yarn is tangentially withdrawn from the rolls.

In another embodiment, the formation of laps is prevented in that the yarn advancing means is composed of one roll which has a conical configuration. In this instance, the roll is mounted from its large end in cantelever fashion, and so that the laps which may form slide downwardly to the small end, where they can be removed. Further, the conical configuration provides for a constant, axial or helical advance of the yarn along its surface, and so that each winding does not superpose another. In this respect, the conical roll is similar to the system utilizing two rolls, the axes of which intersect in the manner described above.

As indicated above, the yarn withdrawal apparatus of the present invention may be mounted to the processing machine as a stationary unit, in which event both mechanical and pneumatic means may be provided for threading the yarn into the yarn advancing apparatus. However, the apparatus may alternatively be designed as a portable, hand-held device, which is similar in size to existing suction guns.

In accordance with the present invention, several different devices and methods are available for threading a yarn into the yarn advancing apparatus. When the roll or rolls of the yarn advancing means are mounted in a depending arrangement, and the suction means is positioned in the area of the bearing end, the following method is suggested in the case of man made fiber spinning operations. Specifically, the yarn advancing from the spinneret at a relatively low speed is first engaged by the suction device, so that it is withdrawn under a tension which can be produced by the suction device alone. The roll or rolls of the yarn advancing means are rotated at a circumferential speed which is at least equal to the circumferential speed of the godet or winding device on the processing machine upon which the yarn is to be threaded, and the apparatus then is moved so that the roll or rolls of the yarn advancing means are moved in a circular motion a number of times about the thread line. As a result, the yarn forms several loops on the roll or rolls. At the end of the procedure, the apparatus should be held so that the yarn advances substantially tangentially to the roll or rolls. In this manner, the contact point of the yarn on the advancing means is prevented from moving in the axial direction. In this condition, the yarn withdrawal apparatus can exert a sufficiently high tension on the yarn so that the yarn can be placed on high speed machine parts, such as godets and/or take-up systems, while effectively avoiding the risk of laps.

The thread-up of the yarn may also be effected by mechanical arrangements. In this case, the procedure is that the yarn is first caught by the suction device, and then a mechanical thread-up device becomes operative for looping the yarn about the roll or rolls of the yarn advancing means. This method is particularly suitable in spinning plants for catching a yarn advancing from the spinneret. After the yarn has been looped about the advancing means of the withdrawal apparatus, the yarn can be placed on high speed machine parts, such as godets and/or take-up systems.

When the yarn is looped about the roll or rolls of the yarn advancing means, it is withdrawn from the spinneret at a relatively high tension, with the level of the tension being a function of the torque of the drive motor and the number of loops of the yarn about the roll or rolls. The torque characteristic of the motor and the number of loops need to be coordinated so that yarn breakage can be avoided. The suction device then serves the purpose of applying relatively low tension in the exiting yarn end, and such tension need be only so high that an adequate tension in the entering yarn end is provided by the looping friction. In addition, a slight tension of the exiting yarn end may be compensated by additional yarn loops.

A further possibility of adjusting and/or regulating the yarn tension is provided in that the contact point of the yarn may be axially adjustable, here the advancing means comprises a conical roll.

Mechanical devices may also be provided for moving the apparatus about the yarn axis after the yarn is caught by the suction system, to loop the yarn about the withdrawal means. However, one embodiment of the present invention includes a mechanically simple and reliable looping device. In particular, the looping device comprises a yarn guide, which rotates or loops about the yarn advancing means, and so as to traverse the thread line in the area of the suction device. As it does so, the yarn guide preferably also imparts an axial advance to the yarn. The guide may for example be a flyer type guide, which is pivotal about an axis which is coaxial or parallel to the roll axis, or which lies in a plane defined by the roll axes in the case of the embodiment consisting of two rolls. The axial advance of the looped yarn may be effected by supporting the flyer in a screw thread, or the guide may be configured to include a helical external arm which performs this function.

As an alternative to the above, the present invention may incorporate pneumatic means, which cooperates with the suction system to loop the yarn about the yarn advancing means. In one such embodiment, which permits high yarn speeds and catches the yarn safely, and which is also easy to operate and may be constructed as a compact hand-operated device, the air stream which entrains the yarn is guided tangentially to the roll, looped about the same, and then tangentially withdrawn. The roll is constantly driven in the rotary direction of the looping air stream and yarn and at a circumferential speed which is at least equal to the circumferential speed of the godet or winding device of the processing machine, upon which the yarn is to be threaded. Where the roll is conical, the air stream is directed so as to impact on the periphery of the roll in a normal plane and in the area of the larger diameter end. In this yarn entry plane, the circumferential speed of the roll is at least equal to the yarn speed. The air stream then moves toward the smaller end of the conical roll.

In one efficient embodiment, the roll is enclosed by an air channel which serves to generate an air vortex, and the channel forms a narrow gap which is spaced from the roll so that the yarn can pass through the channel. The channel may for example be defined by a helically curved, slotted tube. It may b desirable to surround the roll with a casing, and such that the inside surface of the casing forms a narrow gap between the casing and the roll, with the width of the gap being dimensioned so that the yarn can form a small lap on the roll. The helical channel may then be formed on the inside surface of the casing, and so as to extend about the roll for at least half a loop. The yarn inlet and outlet passages which extend through the casing terminate respectively so as to be aligned with the respective ends of the helical channel. Again, the roll may be constructed to have a conical configuration for the purpose of axially advancing the yarn loops, and the interior wall of the casing may have a corresponding conical configuration.

The use of a conical roll has the advantage that the yarn tension adjusts itself automatically. More particularly, as soon as a certain tension is exceeded, the yarn windings slip toward the area of the smaller end, and thus to the area where the circumferential speed is lower. As noted above, this effect may also be intentionally accomplished by the adjustment of the contact point of the yarn with the roll.

Another embodiment which involves pneumatic threading means, comprises a roll which is mounted in a casing, with the casing being adapted to the roll circumference with a gap therebetween. The yarn inlet passage and the yarn outlet passage terminate in the casing, with each of the passages extending along a tangent to the roll. The remainder of the inside surface of the casing is smooth. The direction of rotation is in this case selected so that the periphery of the roll and the air are unidirectional. Thus, the air stream generated by the suction system is deflected as the roll rotates to form an air loop, with the so called Coanda effect playing a role. As the air is sucked in, the yarn is first guided in an air loop around the roll, before it is grasped by the suction system. Surprisingly, it has been found that this embodiment is very reliable in catching the yarn.

Where the roll of the above embodiment is conical, it is possible to effect a multiple looping of the roll in that the yarn suction passage is offset relative to the yarn inlet passage in the axial direction toward the small end. The downward slippage of the yarn windings insures that the free yarn end caught by the roll reaches the area of the yarn suction duct, and is there withdrawn.

In another embodiment which involves pneumatically threading the yarn onto the yarn advancing means, a conical roll is mounted in an overhung or cantilever fashion. More particularly, the yarn suction duct is positioned on a tangent of the roll in the area of its free end, and so that the entrance of the yarn suction duct does not impede the slippage of the yarn wound on the roll toward the free end. The opening of the suction duct is shaped so that it surrounds the free end of the roll in the form of a plate or cup. During threading, the yarn is first brought into circumferential contact with the conical roll, and it forms windings on the roll which slide downwardly toward the free smaller end. As they do so, the downwardly sliding windings drop into the plate or cup shaped opening of the yarn suction duct, from which they are withdrawn by the suction system until the yarn is drawn out smoothly and unwinds tangentially from the conical roll.

The present invention is based upon the recognition that there is no problem with catching an advancing yarn end by means of a suction gun or an air stream, and in particular when the yarn is freshly spun and advances from the spinneret. The tension which is necessary to prevent laps from forming on the feed system below the spinneret may be achieved with the mechanical assistance of the yarn advancing means in accordance with the present invention. In addition, the use of the conical roll of the present invention has the advantage that the formation of laps on the advancing means is effectively avoided, in that possible laps on the conical roll slide downwardly and are entrained with the air flow as it moves through the yarn outlet passage.

To facilitate the removal of laps, the conical roll may be mounted in an overhung or cantilever fashion, and so that the casing of the roll is open adjacent the free end. As a result, possible laps slide downwardly and over the free end of the roll and can fall from the casing or be pulled from the same. It is also possible to provide another suction duct at the open end of the casing, which leads to a waste container.

In accordance with the present invention, the conical roll may take a form which has a constantly decreasing diameter from a normal plane at the point of yarn contact to a normal plane at which the yarn suction duct is located. Thus the shape may include not only truncated cones, but also paraboloids, truncated hyperboloids, and the like.

A high speed electric motor may be provided to drive the yarn advancing means. Alternatively, it may be advantageous to use an air turbine. When the yarn is pneumatically threaded on the advancing means, a control system may be employed, by which the air turbine of the yarn advancing means is operated alone at first. When the yarn advancing means reaches a desired speed, the compressed air may then be supplied to the suction system. In so doing, the yarn advancing means may idle or continue to operate with a reduced air requirement, so that the necessary suction energy is available. After the suction system is also connected, the yarn is taken in, brought into contact with the advancing means, and removed by suction. At this point, the air turbine may again be supplied with a larger portion of the available quantity of pressurized air, so that the advancing means can apply the desired tension. Also, only a lesser energy is necessary for removing the yarn from the advancing means by suction. This control system prevents the yarn from being brought into circumferential contact with the advancing means before the advancing means has reached a desired speed, thereby making the thread-up more reliable and reducing the risk of laps.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
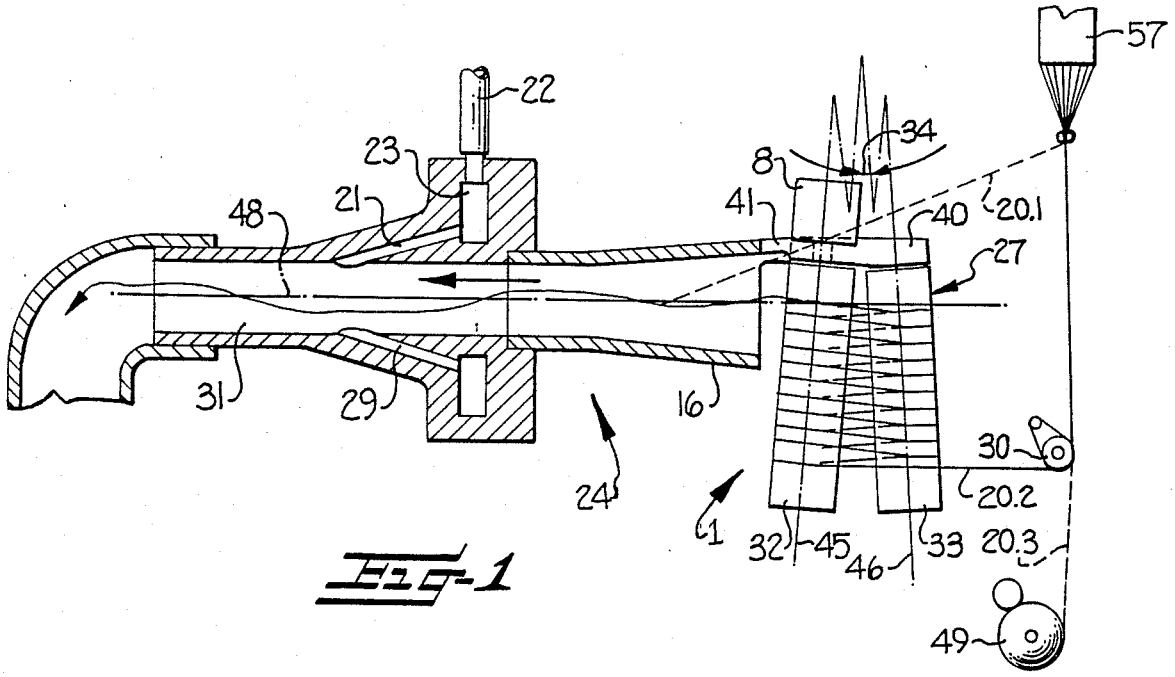
FIG. 1 is a sectional side elevational view of a yarn withdrawal apparatus which embodies the present invention.

Referring initially to the embodiment of the present invention illustrated in FIG. 1, there is illustrated a yarn withdrawal apparatus, which comprises a yarn advancing means 1 and a suction means 24 which includes a suction tube 16 and an air injector nozzle which has an annular duct 23 which is connected via the line 22 to a source of pressurized air. Air channels 21 extend from the duct 23 into the yarn outlet passage 31, where the pressurized air exiting from the channels 21 generates a strong suction current in the direction of the arrow. Positioned adjacent the inlet opening of the tube 16 is the yarn advancing means 1. The advancing means is supported by a holder 40 which is connected via an extension 41 with the wall of the suction tube 16. Supported by the holder 40 are two rolls 32, 33 in such a manner that their axes 45, 46 extend at an acute angle 34 relative to each other, and intersect. It is advantageous to arrange the advancing means 1 adjacent the inlet opening of the suction tube 16, so that the axis 48 of the tube 16 extends substantially in a plane tangent to both rolls 32, 33. Furthermore, the axis 48 of the tube 16 communicates with the yarn advancing means 1 at the unwinding area 27, whereas a substantial portion of the longitudinal length of the advancing means 1 laterally projects beyond the suction tube 16. Thus the yarn will be seen to unwind from the advancing means 1 in the area of the lesser separation between the roll axes.

The yarn outlet passage 31 of the suction means is connected to a flexible tube, which leads to a waste container. Also, the entire apparatus takes the form of a unit having a handle (not shown) which permits it to be manipulated by the operator. Specifically, the suction duct 16 and/or the yarn outlet passage 31 may serve as a handle.

A high speed electric motor is mounted in a casing 8 and drives the roll 32. The motor casing 8 is mounted on the holder 40, and the ro1 33 is supported for free rotation by the holder 40.

When a yarn is to be threaded, such as a yarn advancing from the spinneret 57, the yarn is first taken directly into the suction tube 16 of the suction means 24, and so that the yarn moves along the path 20.1 as shown in dashed lines in FIG. 1. In so doing, it should be noted that the yarn does not advance from the spinneret 57 at a defined speed, and as a result, the suction forces applied by the suction means 24 suffice to withdraw the yarn and so as to avoid the formation of tangles and knots. In the meantime, the roll 32 has been brought to a rotational speed which is sufficiently high so that its circumferential speed corresponds substantially to the operational speed of the yarn and to the circumferential speed of the feed godet 30 of the spinning machine, to which the yarn advancing from the spinneret is to be supplied. Prior to bringing the yarn into circumferential contact with the feed godet 30, the yarn withdrawal apparatus is moved in a generally circular fashion about the yarn axis, and the yarn, which until then has advanced in a straight line, is looped one or several times about the two rolls 32, 33 of the advancing means 1. As the looping increases, the advancing means and particularly the driven roll 32 exert an increasing frictional force on the yarn, so that the yarn is then withdrawn at substantially the operational speed of the godet 30 and at a high tension. At this point, the yarn withdrawal apparatus is guided several times around the feed godet 30, thereby threading the yarn with the desired number of loops onto the godet 30, so that the thread line 20.2 results. The yarn can then be threaded by the apparatus on a take-up system or winder 49, which is schematically indicated in the drawing, and such that the yarn passes along the thread line 20.3.

Figure 2:
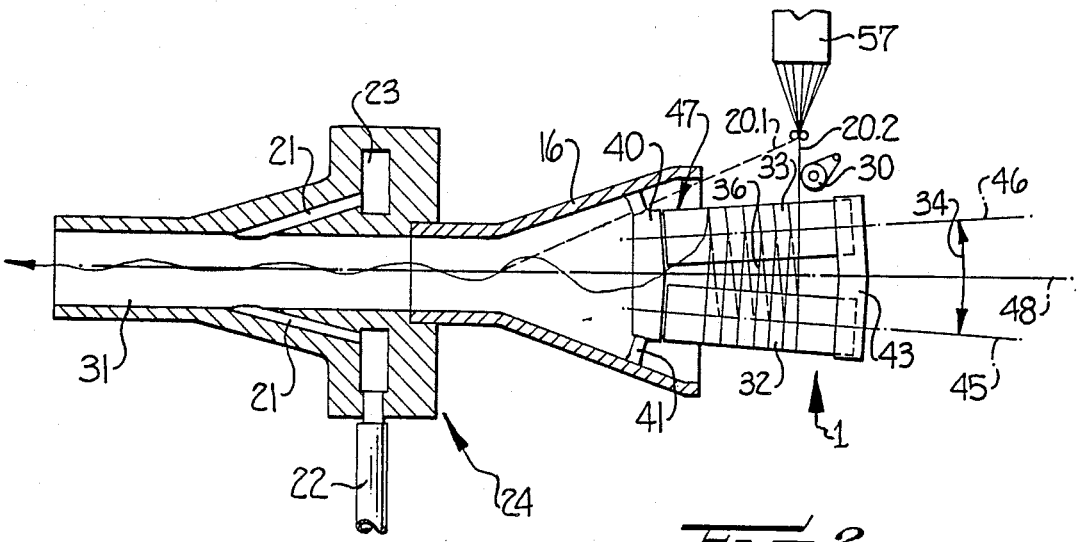
FIG. 2 is a view similar to FIG. 1 and illustrating another embodiment of the invention.
Figure 3C:
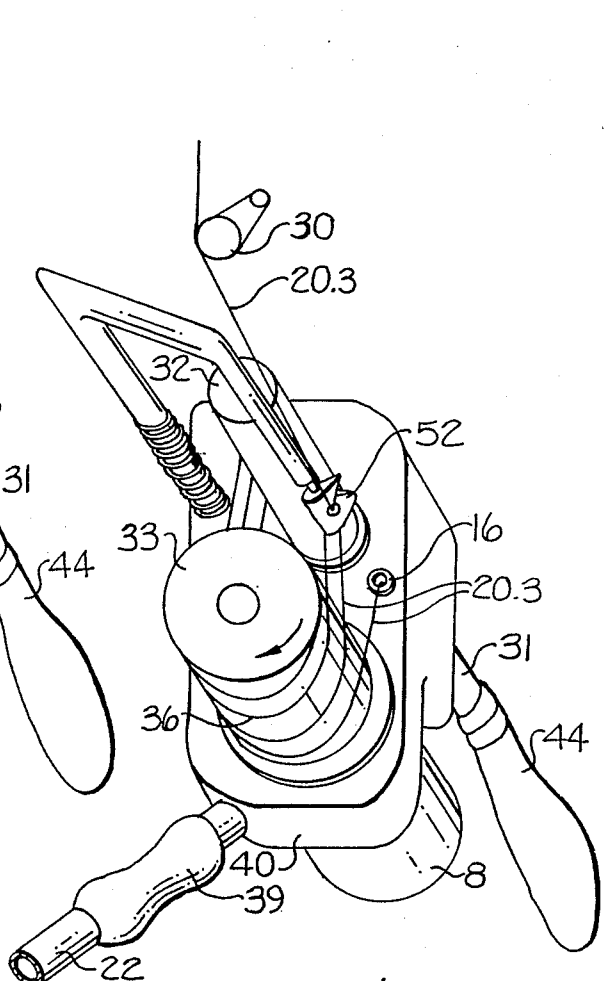
FIGS. 3A, 3B, and 3C are perspective views of another embodiment, and illustrating a mechanical means for looping the yarn about the delivery roll of the yarn advancing means.
Figure 3B:
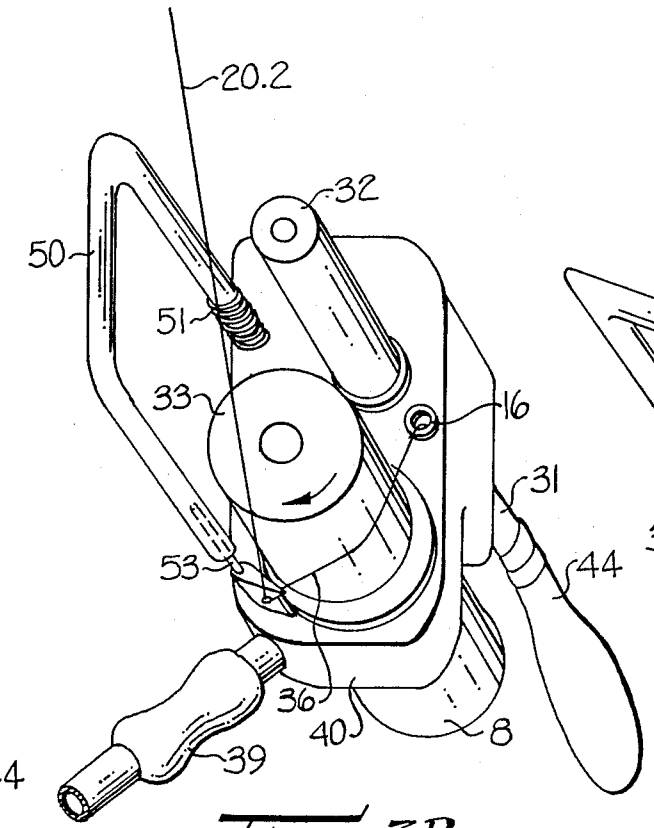
Figure 3A:
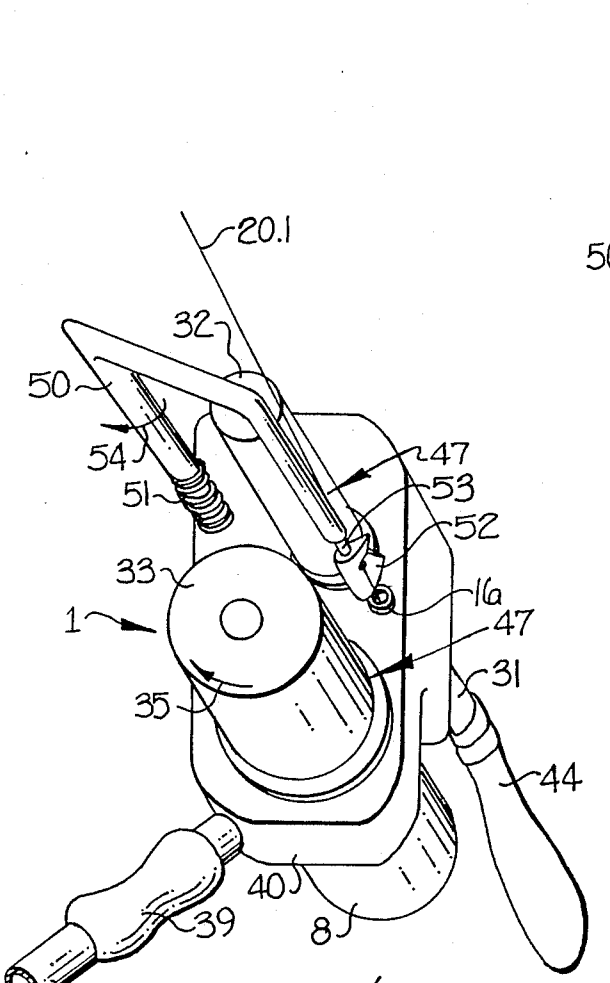

In the embodiment of FIG. 2, the advancing means 1 and the suction means 24 are substantially coaxial or parallel, with the unwinding end 47 of the advancing means 1 being received in the inlet opening portion of the widened suction tube 16. As illustrated, the unwinding portion 47 extends into the inlet opening of the tube 16, and it is also possible, as is illustrated in FIGS. 3A–3C, that the inlet opening of the suction duct 16 terminates at a location which is parallel and offset from the axes 45, 46 of the two rolls. As illustrated in FIG. 2, the holder 40 in which the rolls 32, 33 are supported, is connected via extensions 41 with the wall of the inlet portion of the suction tube 16. Also in this embodiment, the two axes 45, 46 of the rolls extend at an acute angle with respect to each other as indicated at 34. A cap 43 supports the rolls at their free ends and forms an abutment which covers the opposite ends of the two rolls in such a manner that the abutment effectively prevents the yarn from slipping off the ends of the rolls.

The suction tube 16 is connected to a suction means 24, which again comprises an annular duct 23 and connection 22 for the air line, and air channels 21. The entering air thus produces a strong suction current in the tube 16, and the yarn leaving the outlet passage 31 is guided to a waste container.

When threading a yarn onto the godet 30, the yarn advancing from the spinneret is first delivered into the suction tube 16 by the suction means 24, and withdrawn in a straight line as shown by the dashed thread line 20.1 in FIG. 2. The yarn withdrawal apparatus is then rotated several times in such a manner that the axis 48 of the tube performs a circular movement about the thread line 20.1, and so that a desired number of windings is formed on the advancing means 1. The rolls 32 and 33 are put into operation by an air turbine which is housed in the holder 40, and as a result, the yarn is then withdrawn from the spinneret at a speed and under a tension determined by the air turbine, and the extension 41 serves as a yarn guide which prevents the yarn from being withdrawn overhead from the advancing means by the suction force of the means 24. The yarn can then be brought into circumferential contact with the godet 30 along the thread line 20.2.

Aside from the fact that the yarn unwinding from the advancing means 1 is received by the suction means 24, tangentially in FIG. 1, or axially in FIG. 2, the cooperation of the advancing means 1 and the suction means 24 is substantially identical in the two embodiments. The yarn to be withdrawn is in either case looped several times about the two rolls 32, 33 to form windings 36 and withdrawn under an increased tension as a result of the thereby developed frictional contact between the rolls 32, 33 and the yarn. The positioning of the two rolls 32, 33 at an angle 34 facilitates the axial displacement of the individual windings 36, and in the area of the unwinding end 47, the yarn is caught by the suction current of the tube 16, and removed.

In FIGS. 1 and 2, the axes 45, 46 of the two rolls 32, 33 form an acute angle 34. However, they may also be arranged so that their axes extend in planes substantially parallel to each other and are so aligned with each other that they intersect at an acute angle in the projection of one of the two planes.

At least one of the two rolls 32, 33 is driven at high speed, and such that the circumferential speed corresponds at least to the speed of the advancing yarn. This may, for example, be accomplished by an air turbine which is accommodated in the holder 40, or by an electric motor as noted above.

The apparatus of the present invention permits a yarn to be threaded on godets and other yarn advancing systems, such as a yarn take-up or winding system, at circumferential speeds which are far above 4,000 meters per minute and for example up to 7,000 meters per minute. Its utility is based upon the fact that the required yarn tension can be generated by the yarn advancing means 1, and can be adjusted sufficiently high so that no laps form on the godet or take-up winding system. The removal of the yarn unwinding from the advancing means 1 requires high velocities of flow, but only relatively small tension forces.

FIGS. 3A–3C illustrate a yarn withdrawal apparatus in accordance with the present invention, and which incorporates a mechanical threading means for looping the yarn about the yarn advancing means 1. In this embodiment, the rolls 32, 33 of the yarn advancing means 1 are rotatably supported in a holder 40. The roll 33 is driven by a turbine positioned in the housing 8. The axes of the rolls 32 and 33 intersect at an acute angle, and both rolls are supported in the holder 40 so that the distance between their axes decreases from their free ends toward their bearing ends in the holder 40. The direction of drive of the roll 33 is indicated by the arrow 35. The suction means is positioned in the holder 40, and the suction tube 16 is located between the two rolls 32 and 33 and above the plane connecting the roll axes. As previously described in conjunction with the embodiments of FIG. 1 and 2, the suction means includes an annular duct which surrounds the suction tube 16 and which is connected to the tube 16 via air channels. Pressurized air is supplied to the annular duct through an inlet end 22, which also extends through a handle 39. The duct system inside the holder 40 is not shown in detail.

The yarn threading device is a U-shaped, bent rod 50, one end of which is pivotally mounted in the holder 40 and is disposed substantially parallel to the angle bisector between the two roll axes. Further, both the bearing in the holder 40 and the bearing end of the rod 50 are provided with the coarse thread for the purposes described below. Mounted on the other end of the rod 50 is a yarn guide 52. This yarn guide is a so-called "saw-tooth" guide, i.e. it has a catching slot in which the yarn can enter laterally, but once caught it can not leave the same. The yarn guide 52 is pivotable about the axis of the post 53, but is not axially movable. The rod 50 can be pivoted in the direction of the arrow 54, i.e., in the direction of rotation of the yarn advancing rolls 32, 33.

The suction means exhausts through a yarn outlet passage 31 which leads to a waste bag 44 which is clamped thereto. The coarse thread 51 of the rod 50 is so designed that when the rod pivots in the direction of the arrow 54, it performs an axial movement in the direction of arrow 55, note FIG. 3B.

To catch a yarn and thread it onto a godet 30 of the processing machine, the yarn withdrawal apparatus of FIGS. 3A–3C is operated as follows. Initially, the yarn advancing from a spinneret is brought to the area of the opening of the suction tube 16, and drawn off. This is possible, since the yarn does not advance from the spinneret at a defined or very high speed. In the meantime, the air turbine in the housing 8 is actuated by pressurized air, and as a result, the roll 33 is caused to rotate, and so that it is driven substantially at the operational speed of the godet 30 on which the yarn is to be threaded. The yarn then advances along the thread line 20.1 as seen in FIG. 3A. The rod 50 is then rotated in the direction of arrow 54, and as seen in FIG. 3B, the yarn guide 52 will adjust itself to the yarn by rotating about the axis of the post 53. As the rod 50 rotates in the direction of arrow 54, the yarn is looped around the rolls 32 and 33, and since it rotates in the direction 54, the rod 50 also performs an axial movement in the direction of the arrow 55 by reason of the pitch of the coarse thread 51. Thus several axially displaced yarn windings will be looped around the rolls 32, 33 in the manner shown in FIG. 3C. The resulting thread line 20.3 is characterized in that the advancing yarn is first guided through the guide 52, deflected by the guide toward the roll 33, and then guided in two substantially complete windings around the rolls 32 and 33, and is subsequently removed from the roll 33 in its unwinding area 47 and drawn into the suction opening 16 for removal to the waste bag 44. The yarn can then be threaded onto the godet 30 which rotates at a high circumferential speed, and it may possibly also be wound onto a subsequent winding system of the yarn processing machine. By reason of the fact that the axes of the rolls 32, 33 intersect at an acute angle, the yarn windings 36 are axially separated so that no lap can form.

Figure 4:
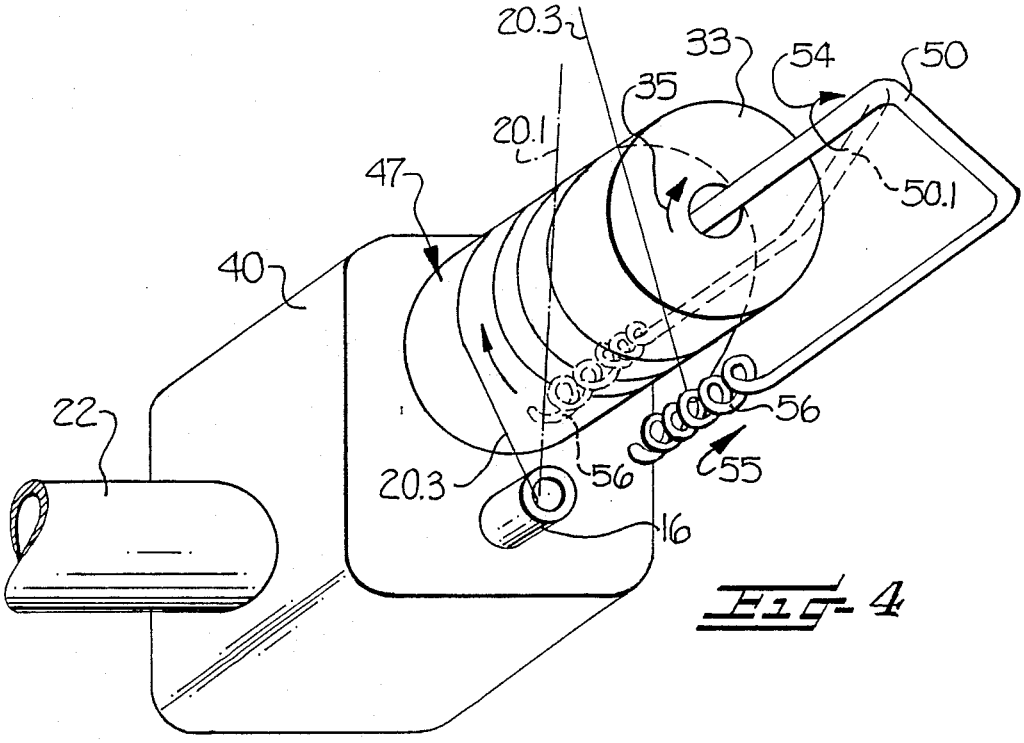
FIG. 4 is a perspective view of another embodiment of the invention.

The yarn withdrawal apparatus as shown in FIG. 4 is provided with only one rotatably driven, cylindrical roll 33, which serves as the yarn advancing means which is supported in the holder 40. The suction tube 16 of the suction means terminates in the area of the unwinding end portion 47 of the roll 33. The roll 33 is driven in the direction 35, and an air turbine may serve as the drive for the roll 33, with the turbine being supplied with pressurized air in the same manner as the suction device, which is through the connection 22. The suction means is, for example, constructed in the manner described above with respect to FIGS. 1–3.

The mechanical threading device in the embodiment of FIG. 4 again comprises a U-shaped rod 50, with one flank supported coaxially through the roll 33, but rotatable independently of the roll in the direction 54. The other free flank of the rod 50 mounts a helically shaped yarn guide 56. To catch the yarn, the yarn is first drawn into the opening 16 of the suction means, and withdrawn in a thread line 20.1. The rod 50 is then rotated to position 50.1, in which the yarn guide 56 reaches the thread line 20.1, and as the rod 50 is further rotated in the direction 54, the yarn moves in the threads of the guide 56 upwardly in the direction of the arrow 55. As a result, the yarn is looped around the roll 33 in a number of windings, and otherwise is held in the thread line 20.3 by the wire guide 56. It should be noted that only a few windings are possible on the cylindrical roll, since otherwise there may be a risk of laps forming. However, it is also possible to use a conical roll for this threading apparatus, and it should be further noted that in the later embodiment, the flank of the rod 50 which is rotatably supported may alternatively be disposed along an axis which is parallel but offset from the axis of the roll 33.

Figure 5:
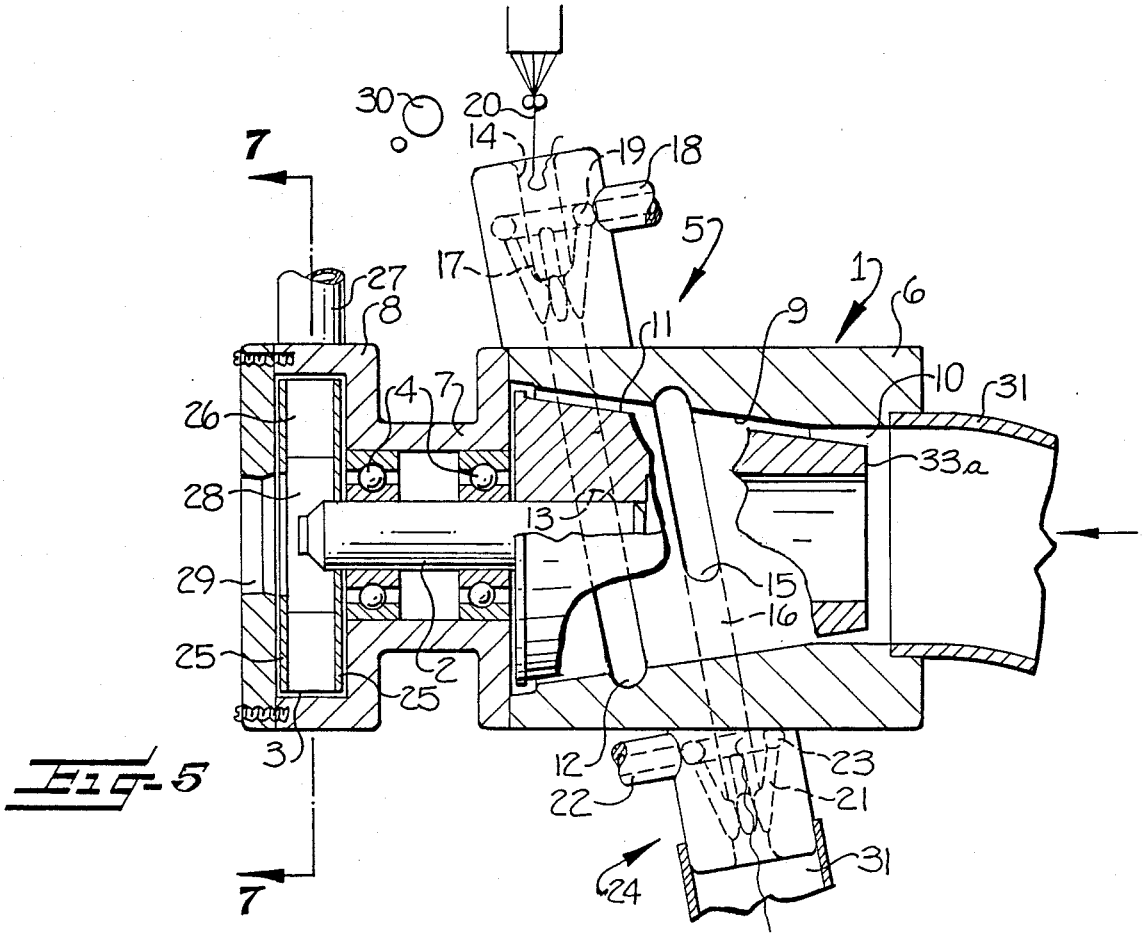
FIG. 5 is a sectional view of still another embodiment of the present invention.
Figure 6:
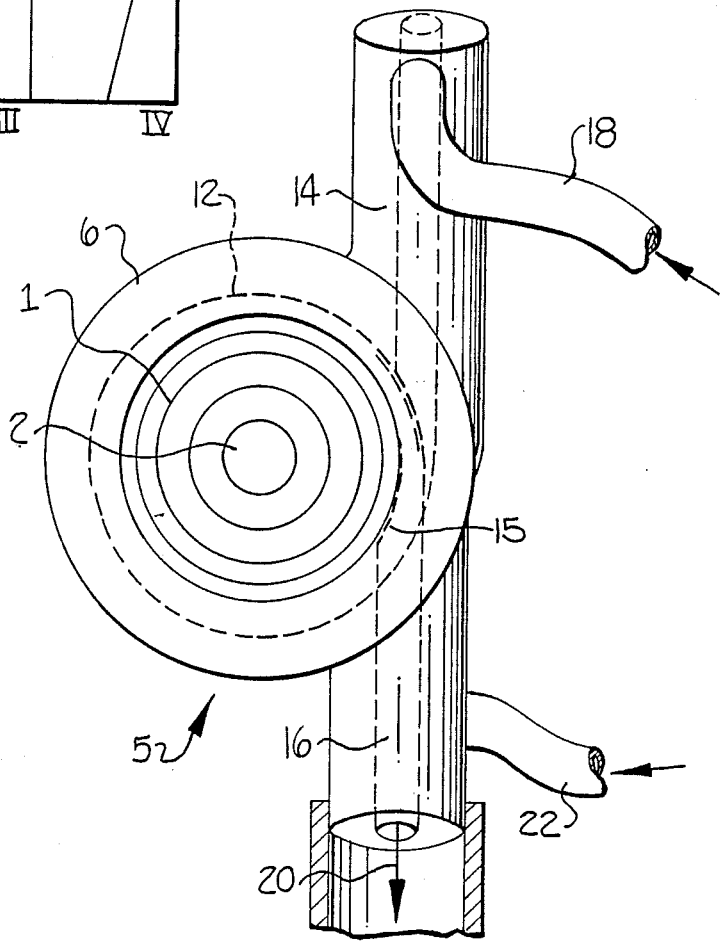
FIG. 6 is an end view of the apparatus shown in FIG. 5.
Figure 7:
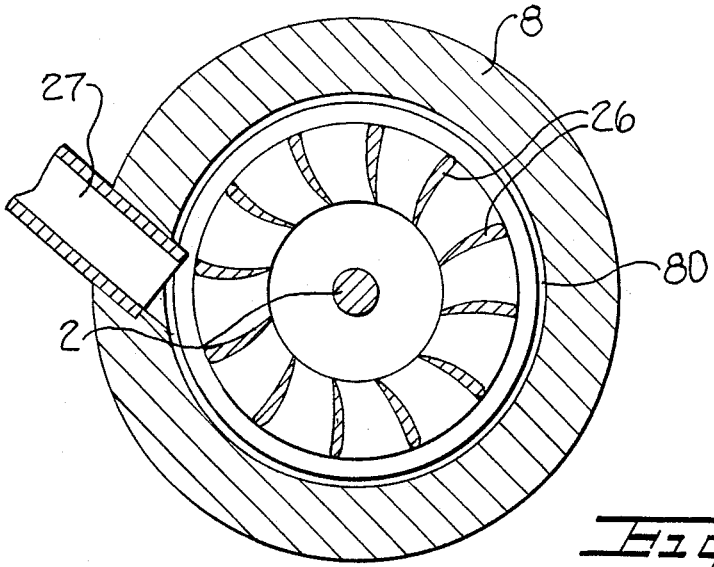
FIG. 7 is a sectional view taken substantially along the lines 7—7 of FIG. 5.

The embodiment of FIGS. 5–7 is characterized by a pneumatic system for threading the yarn onto the advancing roll of the apparatus. More particularly, the yarn advancing system 1 of the apparatus comprises a conical roll **33*a* which is mounted to a shaft 2 which is rotatably supported in bearings 4 for rotation in the housing 5. A turbine 3 is fixedly mounted to the opposite end of the shaft 2. The housing 5 comprises a roll housing portion 6, a bearing housing portion 7 and a drive housing portion 8. A conical bore 9 is positioned in the housing portion 6, which terminates in a cylindrical bore 10. The conical bore 9 surrounds the conical roll 33*a*, leaving a narrow gap 11**.

The shaft 2 may for example have a diameter of about 1 mm, and the inside wall of the conical bore 9 includes a helical channel 12. Also, the wall of the housing includes an inlet opening 13 which communicates with one end of the channel 12, and an outlet opening 15 which communicates with the opposite end of the channel 12 and which also serves as the inlet opening of the suction tube 16.

A yarn inlet housing is mounted adjacent the inlet opening 13, and the housing includes a yarn inlet passage 14 which communicates with the opening 13. The housing also includes injector nozzles 17, which are supplied with air via a connection 18 and an annular duct 19. The injector nozzle 17 generate a partial vacuum at the entry end of the inlet passage 14, so that the advancing yarn end 20 will be drawn inwardly.

A suction means 24 is positioned downstream of the roll, and for this purpose, the yarn duct 16 is provided with injector nozzles 21, which are similarly directed in the direction of material flow, and which are supplied with pressurized air through the tube 22 and the annular duct 23. The suction means generates, or assists in generating a suction air current in the inlet passage 14, channel 12, and the yarn suction tube 16.

The turbine wheel 3 comprises two end plates 25, with a number of turbine blades 26 mounted therebetween, for example by welding, note FIG. 7. The front end plate 25 of the turbine 3 is fixedly connected to the shaft 2, and the turbine housing forms an annular chamber 80 about the turbine. A compressed air passage 27 terminates in the chamber 80, and is directed substantially tangentially into the same. The configuration of its outlet opening is conventional and is generally known in the air turbine art, and is thus not described in greater detail herein. The required air pressure can build up in the annular chamber 80, and so that the turbine wheel can be driven at speeds up to 10,000 revolutions per second.

In the center of the turbine 3, the blades leave an open discharge passage 28. On the bearing side, the passage 28 is closed by the front plate 25, and in the opposite direction the passage 28 communicates with an axial air outlet opening 29 in the housing, and through an opening in the rear disc 25.

Based upon existing experience, it should be noted that the channel 12 in the wall of the bore 9 is suited for assisting in threading the yarn about the roll, and also for a reliable and reproducible catching of the yarn. This is achieved in that the channel serves to develop a high energy flow field in its cross sectional area, the direction of flow being well defined by the channel geometry. Thus it is accomplished that the yarn is advanced from the intake passage 14 and the inlet opening 13 of the channel to the outlet opening 15 of the channel and thus also into the yarn suction tube 16.

To describe the operation of the embodiment of FIG. 5, pressurized air is supplied to the passage 27, and as a result, the turbine 3 and the shaft 2 and the conical roll **33*a* are caused to rotate until the circumferential speed of the godet 30 is reached. Thereafter, the injector nozzles 17 and 21 receive pressurized air via the passages 18 and 22, respectively. As a result, a suction air current develops at the entry to the yarn inlet passage 14, which continues as a looping flow about the conical roll and then exhausts in the outlet tube 16**. The velocity of the air is preferably higher than the yarn speed, and to catch a yarn advancing from a spinneret, it is only necessary that the air flows at least at the yarn speed. It is not necessary that high tension forces be exerted on the yarn. In a fraction of a second, the yarn is looped around the conical roll, and in so doing, the yarn is brought into contact with the surface of the roll. As a result, the yarn is withdrawn by the frictional contact with the surface of the roll.

It should be noted that the circumferential speed of the conical roll **33*a* is, in the area of the yarn contacting plane, at least equal to the yarn speed which is established by the feed godet 30. Preferably, the circumferential speed of the conical roll is also greater than such yarn speed in the area of the outlet opening 15. The roll therefore exerts a considerable friction force on the yarn, and this frictional force suffices to impart a sufficiently high yarn tension so that the yarn can be threaded onto the feed godet 30** without risk of lap formation.

Figure 5A:
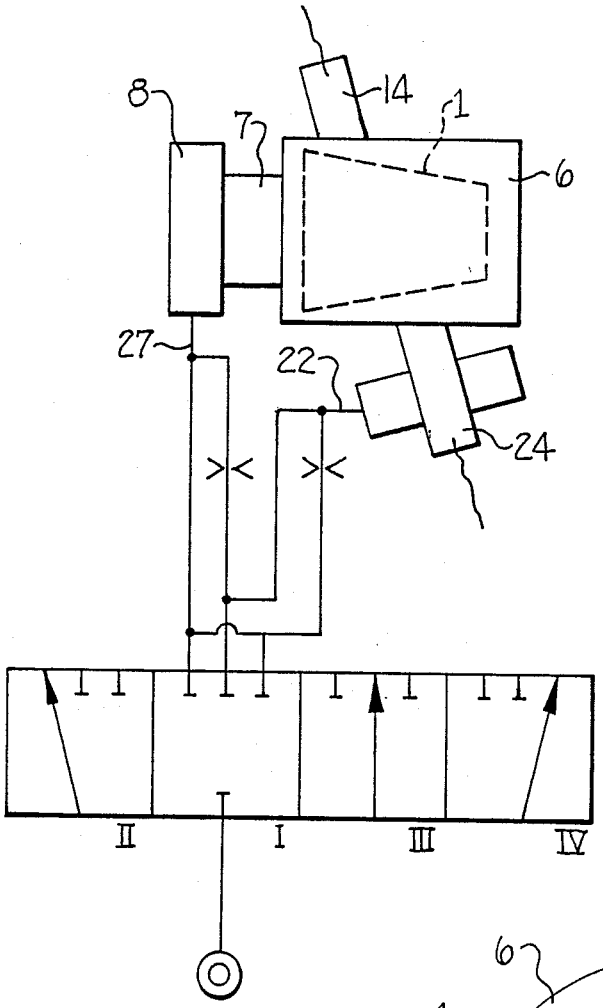
FIG. 5A is a schematic illustration of an air control system for the embodiment of FIG. 5.

FIG. 5A illustrates a manually operable control system for the delivery of pressurized air from a common source to the embodiment of FIG. 5. In the nonoperative condition, the air supply is stopped, which is illustrated by position I. In the manually adjusted position II of the valve, the pressurized air is supplied only the air turbine via line 27. The valve may then be switched to the operating position III, wherein the suction means 24 receives a substantial portion of the available amount of pressurized air via line 22, whereas the turbine is supplied with a reduced quantity by reason of a throttle. It is also possible to entirely disconnect the supply line to the turbine via the throttle. To form a yarn winding on the advancing means, it will usually suffice if the yarn advancing means idles. In the position IV, the valve is switched so that the suction means 24 receives limited air via another throttle, whereas a substantial portion of the air is supplied to the turbine.

As previously mentioned, the channel 12 in the wall of the housing assists in the formation of a loop in the advance of the yarn and an axial feed, as well as in an increased, reliable catching of the yarn. However, tests have unexpectedly shown that a good reliable catching is also achieved when the inside wall of the housing 9 is smooth.

The rotation of the roll **33*a* of the advancing means 1 contributes to the formation of the looping air whirl and the advance of the yarn from the yarn inlet opening 13 to the yarn outlet opening 15, and it is possible to arrange the yarn inlet opening on the same normal plane as the yarn outlet opening. In such case, however, there will be a greater risk of lap formation. As shown in FIG. 5, an axial advance of the feed is achieved and the yarn inlet opening 13 and the yarn outlet opening 15** are axially displaced relative to each other, and with the yarn suction duct being located downstream of the roll so that a defined suction current extends from the yarn inlet opening to the yarn outlet opening, thereby lessening the risk of lap formation.

After the yarn is caught, the air flow in the path extending from the yarn inlet passage 14, channel 12, and suction tube 16 can be substantially reduced, since the yarn is then advanced substantially by reason of its frictional contact with the surface of the conical roll.

It is preferable that the conical roll **33*a* has a diameter which constantly decreases toward its free end during the portion which is engaged by the yarn, and that it have a friction coefficient and an angle of cone which are adapted to each other so that the yarn cannot be held on the surface by self engagement, but will slide downwardly when it is under an appropriate yarn tension. For this reason, the formation of a lap on the conical roll is effectively precluded, and a lap will automatically slide toward the free end of the roll, and in so doing, it will necessarily pass the opening 15, i.e. the entry of the suction tube 16. Most laps will be caught here, and removed through the suction tube 16 by means of the injectors 21. If a lap should form which is not removed at this point, it will continue to slide to the free end of the conical roll, where it either drops out of the housing or can be readily removed. As indicated at 31, a flexible hose may be connected to this portion of the housing and which leads to a waste container. By reason of the fact that there is a considerable air pressure in the gap 11 between the inside wall 9 of the housing and the surface of the conical roll 33*a* as a result of the air flow in the inlet passage 14, channel 12, and yarn outlet tube 16, there will be an adequate air flow in this gap 11 toward the free end of the roll so as to remove remnants of yarns and laps. Moreover, it has been found that a possible lap clogs the gap 11** like a piston, and is advanced by the air pressure which builds up behind it, in the direction of the free end.

Figure 8:
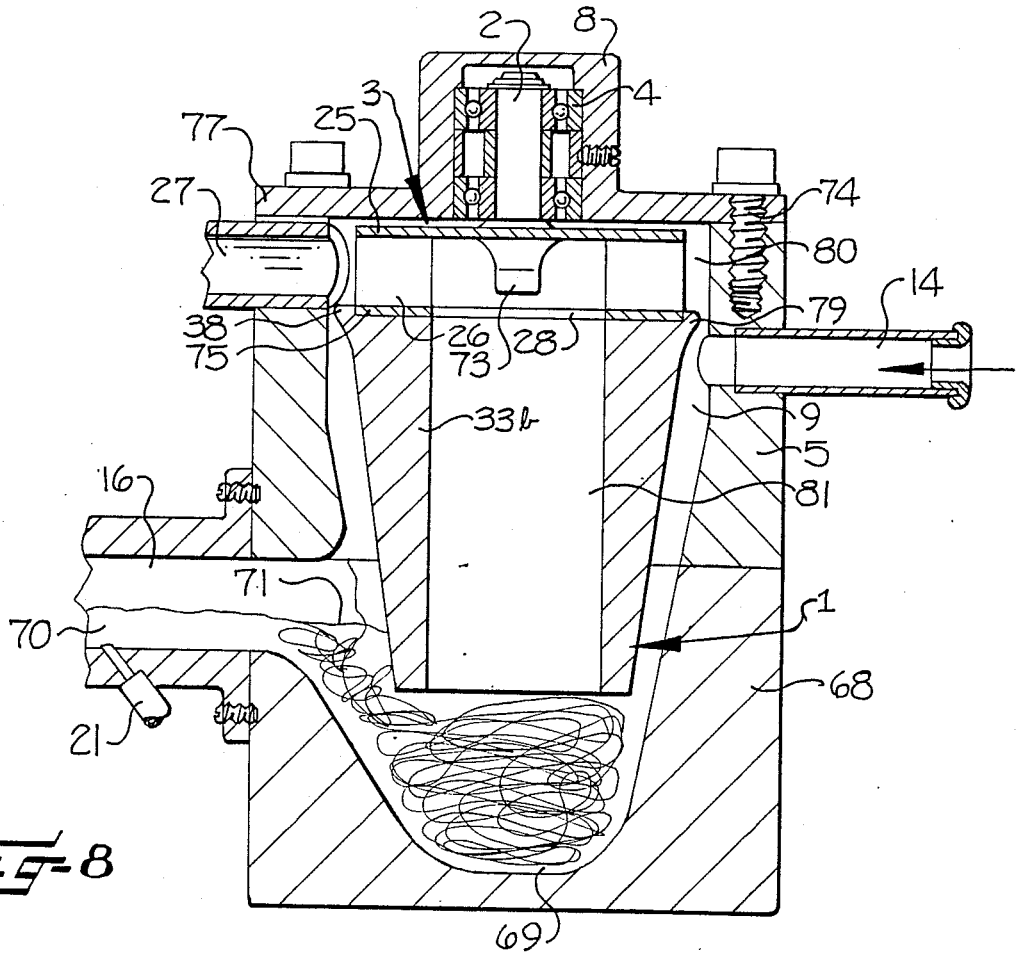
FIG. 8 is a sectional view of a further embodiment of the present invention.
Figure 9:
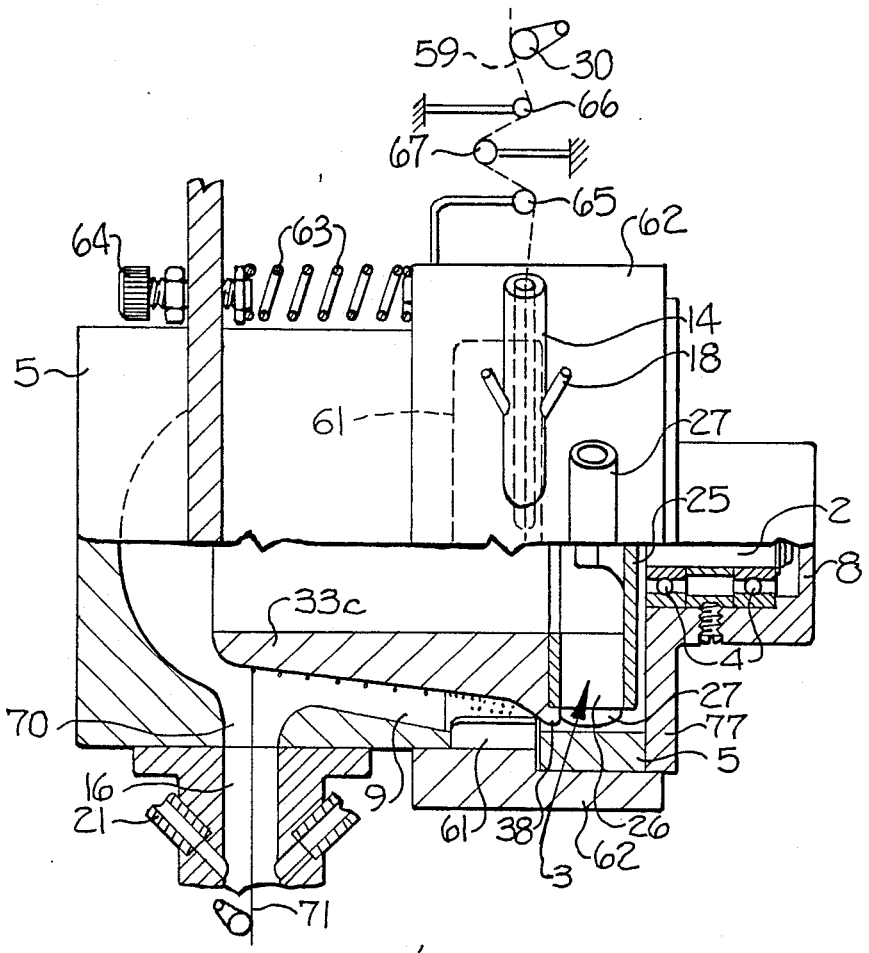
FIG. 9 is a partly section view of still another embodiment of the present invention.

Further embodiments which are adapted for pneumatically threading the yarn are shown in FIGS. 8 and 9. In the embodiment of FIG. 8, the housing 5 is provided with a bore which is tapered in its lower portion 9, and the upper front end of the housing is closed by a cover 77 which is connected with the housing by bolts 74. A housing 8 on the cover 77 is concentric with the bore 9 in the housing 5 and mounts the bearing 4 of the conical roll **33*b*. The roll 33*b* is a component part of a structural unit which comprises a shaft 2, turbine 3, and the roll 33*b*. The shaft 2 is fixedly connected to one plate 25 of the turbine, and is freely rotatable in the housing 8 by means of two ball bearings. The blades 26 of the turbine 3 are mounted between the two end discs 25, note again FIG. 7. Mounted on one of the plates 25 is the advancing roll 33*b*, and the roll has substantially the same conical configuration as the bore 9 in the housing 5. As a result, the winding members form with the bore and annular yarn chamber 9, which also tapers toward the free end of the advancing roll 33*b*. The angle of the cone of the roll 33*b* is smaller than the angle of cone of the bore 9, and as a result, the width of the chamber 9 narrows toward the end of the roll. At its upper mounted end, the advancing roll is provided with a lip 38, which forms with the cylindrical portion of the bore in the housing 5 a narrow passage in the form of an annular nozzle 79**.

The upper cylindrical portion of the bore in the housing 5 forms an annular chamber 80, which houses the turbine 3. A compressed air channel terminates in this annular chamber 80, and the passage 27 is directed substantially tangentially into the chamber 80. Since the lip 38 of the roll **33*b* forms a strong throttling resistance with the cylindrical chamber wall of the housing, the necessary air pressure can build up in the annual chamber 80**, and the turbine can be driven at speeds up to 10,000 revolutions per second.

The blades 26 of the turbine are open in the center thereof to define a discharge passage 28, and the discharge passage is closed toward the bearing end by one of the plates 25. The passage 28 communicates with a central duct 81 which extends through the roll **33*b*, via a large opening in the other disc 25. The post 73 in the center of the turbine 3 is shaped so that the air passing through the blades 26 is deflected in the direction of the central duct 81 in the roll 33*b***.

A yarn inlet passage 14 is positioned in the housing 5 on the side of the lip 38 facing away from the annular chamber 80. The yarn inlet passage 14 is disposed on a plane substantially tangent to the advancing roll **33*b*, and it is possible to arrange the yarn inlet passage 14 on a normal plane of the roll. However, the passage 14 may also be arranged so that it crosses, in the projection of FIG. 8, the axis of the roll at an obtuse angle. In other words, the yarn advancing through the passage 14** may have a component of movement in the direction toward the free end of the roll.

An end piece 68 is attached to the housing 5 and includes a conical, rounded and closed cavity 69. The end piece 68 is further provided with a wide opening 70 on its side, and this opening is rounded toward the cavity and extends in a normal plane in the area adjacent the smallest end of the roll **33*b*. The opening 70 also is aligned with the suction tube 16, which includes a flange which is joined to the end piece 68 of the housing and which is provided with air injectors 21. The cross section of the yarn tube 16 is adapted substantially to the cross section of the opening 70, at the point where the opening 70 communicates with the tube 16**.

To describe the operation of the embodiment of FIG. 8, the same sequential operation is used for threading the yarn as in the embodiments of FIGS. 5 and 5A. Initially, the turbine rotation is started, and the supply of pressurized air to the turbine is substantially restricted, and the suction means in the suction tube 16 is supplied with pressurized air. At this time, the yarn is held in front of the inlet passage 14, and so that it will be drawn therein. The circumferential speed of the roll **33*b* corresponds at least to the yarn speed, and the yarn is thus brought into circumferential contact with the roll and formed into windings, which extend around the roll. As a result of the conical configuration of the roll and the air flow which proceeds from the annular chamber 80 around the lip 38, the windings will advance toward the small end of the roll, where they accumulate. Also by reason of the air flow from the turbine 3 and the air flow in the yarn chamber 9, the yarn tangle falling from the roll is not only collected in the cavity 69, but it is also advanced in the direction of the opening 70 and suction tube 16, as a result of the air flow in the suction tube 16. In the tube 16, the yarn tangle is engaged by the air from the injectors 21, and brought under tension, by which the tangle is again straightened to a smooth yarn. Since the suction tube 16 is located in a normal plane, which intersects the roll in the area of its smallest end, the yarn will then be tangentially withdrawn from the roll, as indicated by the line 71. Thereafter, a substantial portion of the pressurized air is again supplied to the turbine 3, and the suction means receives only so much of the air to assure an adequate tension is produced in the yarn unwinding from the roll, and so as to produce a tension in the yarn advancing to the roll 1** which develops from the loops.

The yarn windings which are formed on the roll **33*b* in the normal plane of the yarn inlet passage, continue to slide along the conical roll, due to low friction and the air flow. The yarn tension upstream of the inlet passage 14 may be adjusted by the adjustment of the speed and the torque of the roll, to be sufficiently high so that the yarn may be threaded on the godet, without laps being formed. The yarn windings which slide downwardly on the conical roll, lose their tension however, so that the yarn can be easily transported into the suction tube 16. The necessary suction flow can be easily generated by the injectors 21**.

The embodiment of FIG. 8 is also suitable for depositing a yarn in the form of a web, felt, or as waste.

The embodiment of FIG. 9 corresponds substantially to that of FIG. 8 with respect to the advance of the yarn, and this embodiment may be used in particular for the waste removal or also for the further processing of the yarn. The arrangement of the yarn withdrawal means of FIG. 9 corresponds to that described in conjunction with FIG. 8, with the following addition. In particular, the housing 5 is provided on its circumference with a wide slot 61 which extends over a portion of the circumference and along a sector angle, such that the yarn can be inserted through this slot and looped about the advancing roll **33*c* of the yarn advancing means 1. A jacket 62 is slideably mounted on the housing 5, and a spring 63 pushes the jacket to its extreme right hand position. Also, the jacket is provided on its periphery with a yarn intake device which includes an inlet passage 14**.

The yarn intake device is directed substantially tangentially to the periphery of the roll 33*c*, and its yarn passage 14 also extends through the jacket 62. The device may be equipped with injectors as indicated at 18, which produce a suction current in the passage 14. Also, the device is disposed so that it is located in its extreme right hand position, which is illustrated in FIG. 9, and substantially in the normal plane and the working area of the advancing roll 33*c*, which has the largest diameter. A yarn guide 65 is also attached to the jacket 62, and the yarn 59 advancing from a spinneret and which is to be threaded onto the feed godet 30 is tensioned between the stationary yarn guides 66 and 67, as well as by the guide 65 which moves with the jacket 62. As a result, the jacket is displaced to the left against the force of the spring 63, as the yarn tension increases. Stationary is here meant that the yarn guides 66 and 67 are not movable relative to the housing 5 of the apparatus.

To describe the operation of the embodiment of FIG. 9, it will be understood that the operation is substantially the same as for the embodiment of FIG. 8, with the following variations. The engagement of the yarn in the circumferential contact with the roll 33*c* is facilitated when the jacket 62 is displaced against the force of the spring 63 and toward the left as seen in FIG. 9, so that the yarn contacts the roll 33*c* initially at a smaller diameter. Once the yarn is caught, the jacket is released to its extreme right hand position, which is defined by the spring 63 and a stop. Since the suction tube 16 extends in a normal plane which intersects the roll 33*c* in the area of its smaller diameter, the yarn is tangentially withdrawn from the roll, as is indicated by the line 71.

The yarn windings on the roll 33*c* will slide further downwardly, due to the conical configuration and low friction, and it is possible to adjust the yarn tension in front of the inlet passage 14, not only by the adjustment of the speed of the roll 33*c*, but also by the displacement of the jacket 62 and thus the point of contact of the yarn with the roll, and such that the yarn can be placed on the feed godet 30 which operates at a constant, high circumferential speed, without risk of laps. However, the windings which slide downwardly on the roll lose their yarn tension, so that the yarn which advances, for example, to a waste container or a container for collection or transport, can be easily advanced in the suction tube 16, and the required air flow can be easily produced by the injectors 21.

As is also indicated in FIG. 9, the yarn can be withdrawn by an additional delivery system. Furthermore, the yarn withdrawal apparatus may serve to control the yarn tension between the feed godet 30 and the yarn withdrawal apparatus. To this end, the yarn is guided in the illustrated manner over the yarn guides 66, 67, 65 which serve to monitor the yarn tension.

The width of the slot 61 defines the working range in which the yarn contact point of the roll 33*c* can be displaced. Depending on the position of the yarn guide 65 and the yarn intake device, the yarn is wound on the roll 33*c* at a higher or lower winding speed, thus making it possible to control and regulate the yarn tension by adjusting the position of the jacket 62. When the yarn tension increases, the yarn guide 65 and thus also the jacket 62 are displaced to the left, whereby the yarn intake device comes to lie in a normal plane having a smaller diameter. Consequently, the winding speed is lowered and the yarn tension is reduced. An equilibrium is thus obtained between the yarn tension, and the force of the spring 63. It is therefore possible to preset a desired value of the yarn tension by adjusting the force of the spring 63, and thus insuring that the yarn tension which the yarn withdrawal apparatus imparts to the yarn, is always adequate to avoid laps on the feed roll 30, or to exert constant forces on the yarn for influencing its properties.

In the drawings and specification, there has been set forth preferred embodiments of the invention, and although specific terms are employed, they are used in a generic and descriptive sense only, and not for purposes of limitation.

We claim:

1. An apparatus for continuously withdrawing an advancing yarn and comprising a support structure including a housing, yarn advancing means rotatably mounted to said housing of said support structure and comprising a single rotatable roll which is adapted to be looped by the advancing yarn, with said roll having a first end portion and an opposite second end portion, drive means mounted to said support structure for rotating said roll at a predetermined rotational speed, suction means mounted to said support structure and having an inlet opening closely adjacent said yarn advancing means for withdrawing a yarn which is looped about said roll; and said housing having an interior wall which generally conforms to the surface of said roll with a small gap therebetween, with the width of said gap being greater than the diameter of the yarn, and wherein said housing includes an inlet passage adjacent said first end portion and an outlet passage adjacent said second end portion, and with said outlet passage communicating with said inlet opening of said suction means.

2. The apparatus as defined in claim 1 wherein said roll is a conical roll and wherein said first end portion has a larger diameter than said second end portion and wherein said larger diameter first end portion is mounted to said housing and said second end portion is free.

3. The apparatus as defined in claim 2 wherein said interior wall of said housing includes a helical channel extending between said inlet passage and said outlet passage of said housing.

4. The apparatus as defined in claim 3 wherein said helical channel extends for at least 180° about the surface of said roll.

5. The apparatus as defined in claim 4 wherein both said inlet passage and said outlet passage of said housing are disposed so as to be substantially tangent to the surface of said roll.

6. The apparatus as defined in claim 1 wherein said housing includes an opening which is in axial alignment with said second free end portion of said roll.

7. An apparatus for continuously withdrawing an advancing yarn and comprising a support structure, yarn advancing means mounted to said support structure and comprising a single rotatable roll which is adapted to be looped by the advancing yarn, drive means mounted to said support structure for rotating said roll at a predetermined rotational speed, suction means mounted to said support structure and having an inlet opening closely adjacent said yarn advancing means for withdrawing a yarn which is looped about said roll; and means defining a helical channel surrounding the roll with a small gap between the surface of the roll and said channel defining means, and with said channel defining means having an opening along its entire length which opens into said gap, a yarn inlet passage at one end of said channel defining means, and a yarn outlet passage at the other end thereof which communicates with said inlet opening of said suction means.

8. The apparatus as defined in claim 7 wherein said yarn inlet passage and said yarn outlet passage open in opposite directions, and wherein said drive means rotates said roll in a direction such that the surface of the roll moves in a direction extending generally away from said inlet passage and toward said outlet passage of said channel defining means.

9. A method of withdrawing a freshly spun yarn from a spinneret and of threading the yarn to a rotating yarn receiving means and comprising the steps of engaging the yarn emerging from said spinneret by entraining the yarn in an air current, guiding said air current and entrained yarn so as to loop around a roll by more than 180°, rotating said roll in the same direction as the air current is looped around said roll and at a circumferential speed at least equal to the circumferential speed of said yarn receiving means, tangentially withdrawing said air current and entrained yarn after being looped around the roll by means of a suction air current drawn into a suction opening which is disposed tangentially to said roll, and such that a force is exerted on the yarn emerging from said roll by means of said suction air current, and such that the yarn is looped around said roll and continuously withdrawn from said spinneret by said roll and advanced into said suction opening, and then threading the portion of the yarn extending between said spinneret and said roll onto said rotating yarn receiving means.

10. The method as defined in claim 9 wherein said guiding step includes guiding said air current and entrained yarn so as to lop around a conical roll by more than 180°.

11. The method as defined in claim 9 wherein the step of rotating said roll includes rotatably driving said roll by an air driven turbine, and wherein said tangentially withdrawing step includes generating a suction air current by a suction nozzle, and comprising the furterh step of supply pressurized air to said turbine and said suction nozzle from a common source.

12. A method for withdrawing a freshly spun yarn from a spinneret and for threading the same to a rotating yarn receiving means and comprising the steps of engaging the yarn emerging from said spinneret by means of a suction air current being drawn into a suction opening, and so as to withdraw the yarn from said spinneret, then bringing the portion of said yarn between said spinneret and said suction opening into contact with a yarn delivery means comprising two rolls which are mounted in an adjacent side by side arrangement, and wherein the two rolls define rotational axes which intersect each other at an acute angle, rotating driving at least one of said rolls with a circumferential speed which is at least equal to the circumferential speed of said rotating yarn receiving means, and looping the portion of said yarn between said spinneret and said suction opening around said yarn delivery means by at least 360°, and then threading the portion of the yarn extending between said spinneret and said yarn delivery means onto said rotating yarn receiving means.

13. A method of withdrawing a freshly spun yarn form a spinneret and comprising the steps of providing a roll of conical configuration having a larger diameter end portion and a smaller diameter end portion, with said roll being mounted in cantilever fashion at the larger diameter end portion thereof, engaging the yarn around said roll by more than 180°, while rotating said roll at a circumferential speed at least equal to the yarn withdrawal speed, and including depositing the yarn onto the larger diameter end portion of said roll, tangentially withdrawing said yarn from the smaller diameter end portion of the roll after being looped around the roll by means of a suction air current drawing into a suction opening which is disposed tangentially to said roll, and such that a force is exerted on the yarn emerging from said roll by means of said suction air current, and such that the yarn is looped around said roll and continuously withdrawn from said spinneret by said roll and advanced into said suction opening, and then depositing the yarn in the form of a web or a felt.

14. The method as defined in claim 13, wherein the step of entraining the yarn in an air current includes guiding said air current tangentially onto the larger diameter end portion of said roll, the looping step includes looping said air current around said roll by more than 180° and said withdrawing step includes withdrawing said air current tangentially from the smaller diameter end portion of said roll by means of said suction air current.

15. The method as defined in claim 13 comprising the further step of adjusting said suction air current to provide sufficient air to assure an adequate tension in the yarn unwinding form the roll.

16. In yarn processing apparatus having means for continuously processing and advancing a yarn along a predetermined path of travel, the combination therewith of an auxiliary yarn withdrawal means for continuously withdrawing the advancing yarn from said predetermined path of travel to facilitate yarn thread-up and the like, said yarn withdrawal means comprising a support structure, yarn advancing means mounted to said support structure and comprising two rotatable rolls, said two rolls being mounted in an adjacent side-by-side arrangement and defining rotational axes which intersect each other at an acute angle, and such that said rolls are adapted to be collectively looped by the advancing yarn, drive means mounted to said support structure for rotating at least one of said rolls at a predetermined rotational speed, a yarn waste container, and suction means mounted to said support structure and having an inlet opening closely adjacent said two rolls for withdrawing a yarn which is looped about said rolls and conveying the same to said yarn waste container.

17. The apparatus as defined in claim 16 wherein said two rolls include two end portions which are closet to each other and which define a yarn unwinding end portion of said yarn advancing means, and wherein said inlet opening of said suction means is positioned adjacent said yarn unwinding end portion.

18. The apparatus as defined in claim 17 wherein said yarn unwinding end portion of said yarn advancing means extends into said inlet opening of said suction means.

19. The apparatus as defined in claim 16 wherein said yarn withdrawal means is mounted so as to permit free movement thereof with respect to said means for continuously processing and advancing a yarn, and is sized and configured so as to be able to be manipulated by an operator.

20. In yarn processing apparatus having means for continuously processing and advancing a yarn along a predetermined path of travel, the combination therewith of an auxiliary yarn withdrawal means for continuously withdrawing the advancing yarn from said predetermined path of travel to facilitate yarn thread-up and the like, said yarn withdrawal means comprising a support structure, yarn advancing means mounted to said support structure and comprising a conical roll which is adapted to be looped by the advancing yarn, said conical roll having a large diameter end portion and a smaller diameter free end portion, drive means mounted to said support structure for rotating said at least one roll at a predetermined rotational speed, a yarn waste container, guide means mounted to said support structure for guiding an advancing yarn onto said large diameter end portion of said roll, and suction means mounted to said support structure and having an inlet opening closely adjacent said free end portion of said roll for withdrawing a yarn which is looped about said roll and conveying the same to said yarn waste container.

21. The apparatus as defined in claim 20 wherein said drive means comprises an air driven turbine, and wherein said suction means comprises a suction nozzle mounted in an air passageway and having air channels for injecting pressurized air into said air passageway so as to generate a suction current through said inlet opening.

22. The apparatus as defined in claim 21 further comprising control means for delivering selective quantities of pressurized air to each of said air driven turbine and said suction nozzle.

23. The apparatus as defined in claim 22 wherein said yarn withdrawal means is mounted so as to permit free movement thereof with respect to said means for continuously processing and advancing a yarn, and is sized and configured so as to be able to be manipulated by an operator.

24. In yarn processing apparatus having means for continuously processing and advancing a yarn along a predetermined path of travel, the combination therewith of an auxiliary yarn withdrawal means for continuously withdrawing the advancing yarn from said predetermined path of travel to facilitate yarn thread-up and the like, said yarn withdrawal means comprising a support structure, yarn advancing means mounted to said support structure and comprising at least one rotatable roll, drive means mounted to said support structure for rotating said at least one roll at a predetermined rotational speed, a yarn waste container, yarn delivery guide means including a yarn guide outlet, yarn suction means including a yarn inlet opening for withdrawing a yarn from said yarn guide outlet and conveying the same to said yarn waste container, said inlet opening being disposed to open along a direction which is parallel to the axial direction of said one roll, and means mounting said yarn delivery means and said yarn suction means to said support structure so as to permit relative rotation of said yarn guide outlet and said yarn inlet opening a the circumferential direction about said one roll and between (a) a yarn catching position wherein said yarn guide outlet and said yarn inlet opening are disposed yarn guide outlet and said yarn inlet opening are disposed immediately adjacent to each other and aligned along a direction substantially parallel to the axial direction of said at least one roll, and (b) a drawing-off position, and whereby such relative rotation causes a yarn passing from said yarn guide outlet to said yarn inlet opening to be at least partially looped about said one roll.

25. The apparatus as defined in claim 24 wherein said yarn suction means is mounted at a fixed location with respect to the axis of said one rotatable roll, and said yarn delivery guide means is mounted for movement such that said yarn guide outlet is movable circumferentially about the axis of said one roll.

26. The apparatus as defined in claim 25 wherein said means mounting said yarn delivery means includes means for axially advancing said yarn guide outlet as the same moves about the axis of said one roll.

* * * * *